United States Patent [19]

Guerlet et al.

[11] 4,427,627

[45] Jan. 24, 1984

[54] COPPER ALLOY HAVING HIGH ELECTRICAL CONDUCTIVITY AND HIGH MECHANICAL CHARACTERISTICS

[75] Inventors: Jean-Paul Guerlet; Claude Niney, both of Paris, France

[73] Assignee: Comptoir Lyon-Alemand Louyot, Paris, France

[21] Appl. No.: 247,092

[22] Filed: Mar. 24, 1981

Related U.S. Application Data

[63] Continuation of Ser. No. 63,702, Aug. 6, 1979, abandoned, which is a continuation of Ser. No. 883,247, Mar. 3, 1978, abandoned.

[30] Foreign Application Priority Data

Mar. 9, 1977 [FR] France ..... 77 06999
Feb. 7, 1978 [FR] France ..... 78 03410

[51] Int. Cl.[3] ..... C22C 9/06
[52] U.S. Cl. ..... 420/496; 420/499

[58] Field of Search ..... 75/153, 154; 420/496, 420/499

[56] References Cited

U.S. PATENT DOCUMENTS

| | | | |
|---|---|---|---|
| 2,123,629 | 7/1938 | Hensel et al. | 75/153 |
| 2,130,378 | 9/1938 | Hensel et al. | 75/153 |
| 2,286,734 | 6/1942 | Harrington | 75/154 |
| 3,640,779 | 2/1972 | Ence | 75/153 |
| 3,677,745 | 7/1972 | Finlay et al. | 75/153 |
| 3,698,965 | 10/1972 | Ence | 75/153 |
| 3,976,477 | 8/1976 | Crane et al. | 75/153 |

*Primary Examiner*—Peter K. Skiff
*Attorney, Agent, or Firm*—Bacon & Thomas

[57] ABSTRACT

The present invention relates to a copper alloy, essentially comprising 0.10 to 0.50% by weight of cobalt, 0.04 to 0.25% by weight of phosphorus, the remainder being copper. It also relates to a process for the treatment of said alloys with a particular view to improving the electrical conductivity thereof.

5 Claims, No Drawings

COPPER ALLOY HAVING HIGH ELECTRICAL CONDUCTIVITY AND HIGH MECHANICAL CHARACTERISTICS

This is a continuation of application Ser. No. 63,702, filed Aug. 6, 1979, abandoned, which is a continuation of Ser. No. 883,247 filed Mar. 3, 1978 abandoned.

The present invention relates to a copper alloy having a high electrical and thermal conductivity, good mechanical characteristics and a high restoration temperature, at the same time.

These requirements are contradictory in the facts, the increase in the restoration temperature and the mechanical properties of the copper generally being effected by addition of elements, one of the effects of which is also to reduce the electrical conductivity.

Users of these alloys most often accept a more or less advantageous compromise, as none of the heretofore known alloys combines an entirely satisfactory set of properties,

- either the alloys do not possess a completely satisfactory set of characteristics from the triple point of view mentioned hereinabove,
- or the alloys tend towards a good compromise of mechanical and electrical properties, but have other drawbacks which generally reside in the difficulties of elaboration, manufacture or treatment.

The alloys which owe their mechanical properties essentially to the presence of Be, Zr, Cr, are difficult to elaborate and are expensive and those which owe their properties essentially to the presence of Fe, Cd, Ag, have mediocre performance.

The alloy according to the invention has properties which overcome all the above-mentioned drawbacks. It is distinguished from prior known alloys in that it offers, simultaneously:

- a high electrical conductivity: 75 to 95% IACS,
- a high thermal conductivity greater than 90% of the conductivity of pure copper,
- a high mechanical characteristics capable of reaching 50 to 55 daN/mm$^2$ tensile strength measured in traction for rolled articles and of exceeding these values for wire-drawn or drawn products,
- a restoration temperature starting high, which may reach 500° C. and even, in certain cases, exceed this value.

Moreover, the copper alloy forming the subject matter of the invention does not owe its properties to any addition element, whose price is prohibitive or whose presence may involve difficulties in elaboration, manufacture or use.

Such a set of properties is obtained by incorporating in the copper an addition of 0.1 to 0.5% by weight of cobalt and from 0.04 to 0.25% of phosphorus.

The preferred compositions contain from 0.05 to 0.12% phosphorus and from 0.15 to 0.35% of cobalt.

Moreover, within these ranges, the alloys give better results if the Co and P compositions are such that the weight ratio Co/P is included between 2.5 and 5. It has been noted that within this range the alloys having a ratio Co/P of between about 2.5 and 3.5 had a still higher restoration temperature than the others.

In the alloys according to the invention, part of the cobalt may be replaced by nickel and/or iron. In fact, it has been noted that the presence of Ni and/or Fe generally never very substantially improves the properties of the alloys and does not present considerable drawbacks insofar as the Ni+Fe percentage by weight is not higher than 0.15%. In addition, the Ni content must not exceed 0.05% and the Fe content 0.1%.

Thus, the alloys according to the invention may contain, apart from the copper,

- from 0.1 to 0.5% by weight of cobalt,
- from 0.04 to 0.25% by weight of phosphorus,
- up to 0.15% by weight of Ni+Fe with a limitation of the nickel content to 0.05% and of the iron content to 0.1%.

In these alloys, the best results are obtained when the Co content is between 0.12 and 0.3% and the phosphorus content between 0.05 and 0.12% and, if the weight ratio of (Co+Ni+Fe)/P is between 2.5 and 5.

Moreover, it has been noted that an addition of Mg, Cd, Ag, Zn, Sn, taken separately or in combination, improves the mechanical properties and the behavior at restoration of the above defined alloys without adversely affecting the physical characteristics, particularly the electrical conductivity.

These elements may be added in the following proportions by weight:

Mg: from 0.01 to 0.35%
Cd: from 0.01 to 0.70%
Ag: from 0.01 to 0.35%
Zn: from 0.01 to 0.70%
Sn: from 0.01 to 0.25%

Combined together, the total of the addition obtained with these different elements must not exceed 1%. The above mentioned elements will preferably be used in the following proportions:

Mg: 0.01 to 0.15% by weight
Cd: 0.01 to 0.25% by weight
Ag: 0.01 to 0.15% by weight
Zn: 0.01 to 0.2% by weight
Sn: 0.01 to 0.1% by weight The addition obtained by combining several elements will preferably not exceed 0.5% by weight.

A variant of the alloys according to the invention therefore contains, apart from copper, 0.1 to 0.5% of cobalt
0.04 to 0.25% of phosphorus, and one of the elements chosen from Mg, Cd, Zn, Ag, Sn, in contents ranging, for Mg, from 0.01 to 0.35%, Cd, from 0.01 to 0.7%, Ag, from 0.01 to 0.35%, Zn from 0.01 to 0.7%, Sn, from 0.01 to 0.25%, or several elements from the list comprising Mg, Cd, Zn, Ag, Sn provided that the above set limitations are respected and that their total does not exceed 1%.

Among these alloys, those which are preferred and which give the best characteristics contain, apart from copper, 0.15 to 0.35% Co
0.05 to 0.12% P, and one of the elements chosen from Mg, Cd, Ag, Zn, Sn in contents ranging, for Mg, from 0.01 to 0.15%, Cd, from 0.01 to 0.25%, Ag, from 0.01 to 0.15%, Zn, from 0.01 to 0.2%, Sn, from 0.01 to 0.1%, or several elements from the list Mg, Cd, Ag, Zn, Sn, provided that the above set limits are respected and their total does not exceed 0.5%.

Naturally, in these variants of the alloys according to the invention, Co and P contents will preferably be kept such that the Co/P ratio by weight remains between 2.5 and 5.

It also remains possible to replace a part of the cobalt by nickel and/or iron on condition that the previously set limitations for these two elements be respected and that the ratio (Co+Ni+Fe)/P preferably remains between 2.5 and 5. Within this range, the alloys possessing a ratio (Co+Ni+Fe)/P of between 2.5 and 3.5 have a restoration temperature higher than the others.

It has been noted that, if Co and P contents are used which are lower than those provided for the alloys according to the invention, the qualities of the materials obtained are not satisfactory due to a deficiency in the mechanical qualities and too low a restoration temperature. On the contrary, an excess of the set contents of Co and/or P in the invention leads to a substantial reduction in the electrical properties.

It has also been noted that the properties of the alloys are no longer quite as satisfactory when the weight ratio Co/P is no longer between 2.5 and 5. These effects generally appear slightly less when the alloys contain Mg, Cd, Ag, Zn and Sn and, among these, Cd, Mg and Ag in particular.

On the other hand, it has been noted that an addition of the elements Mg, Cd, Ag, Zn, Sn, taken alone or in combination, reinforces the mechanical properties and raises the restoration temperature without substantially affecting the other properties of the alloys. However, an excess of the contents set within the scope of the invention leads to a lowering of the electrical conductivity. This effect is more particularly marked with Zn, Sn, Mg.

It has also been noted that, if the elements Mg, Cd, Ag, Zn and Sn are used at contents lower than 0.01%, the alloys thus produced do not present substantial improvements.

It is understood that the alloys according to the invention may contain impurities in traces, or may contain, in small proportions, a deoxidising element other than those mentioned hereinabove.

The alloys according to the invention as cast and/or cold rolled, could be used directly as electrical and thermal conductors.

However, their mechanical and electrical characteristics may be improved substantially, as well as their restoration temperature, by means of heat treatments and cycles of deformations.

The invention also relates to a process for treating a cold-rolled alloy according to the invention, wherein at least one annealing is effected between about 500° and 700° C., followed by a cold-rolling.

According to a variant, the invention also relates to a process for treating a cold-rolled alloy according to the invention, wherein the alloy thus obtained is dissolved between 700° and 930° C. The alloy is sharply cooled, preferably by quenching, and a cold-rolling is effected. For this latter process, tempering is carried out at about 500° C., which operation is preferably inserted between the dissolving and the subsequent cold-rolling.

According to another variant of the present invention, it is possible to effect the dissolving during a hot deformation operation. The alloys according to the invention are then preheated to about 800°–950° C., deformed hot by rolling or extrusion and quenched after hot shaping whilst they are still at a temperature higher than about 600° C. A cold-rolling and a tempering operation are effected on the products thus obtained, at around 500° C., which operation is preferably inserted between the quenching and the cold-rolling.

It should be emphasized that it is after a dissolving treatment followed by a tempering treatment and cold-rolling that the alloys according to the invention present the best characteristics.

The advantages and features of the invention will be more readily seen on reading the following examples given by way of illustration and in no way limiting. All the percentages of the constituents of the alloy are given in % by weight with respect to the total weight of the alloy.

All the rates of cold-rolling which are indicated are calculated according to formula:

$$\left(\frac{S_o - S}{S_o} \times 100\right)$$

$S_o$=section of the product before deformation, S=section of the product after deformation.

The sizes and indices of grains have been assessed according to standard AFNOR 04-104, the traction tests made according to the draft standard AFNOR A 03-303 and A 03-301 of February 1971 and the hardness measured according to the Vickers process, generally under a load of 5 or 10 kg.

EXAMPLE 1

Within the scope of industrial manufacture, three alloys noted A, B and C whose composition is given in Table I hereinafter, are melted in a slightly oxidising atmosphere, in a siliceous pise crucible.

Alloy A is in accordance with the invention, whilst alloys B and C are not in accordance with the invention. After deoxidation by a suitable element other than phosphorus, ingots are cast. These ingots are subsequently reheated to 930° C. and rolled hot with a view to reducing their thickness from 120 to 9.4 mm.

On leaving the hot rolling mill, the alloys are quenched whilst they are still at a temperature of 700° C. After surfacing, the alloy is rolled cold with a view to reducing its thickness from 8.6 to 2.2 mm and it is annealed at different temperatures for 1 hr. 30 mins.

The measurements of Vickers hardness and of grain index obtained after treatment are shown in Table II hereinafter.

According to this Table, it appears that the temperature of restoration of the alloy A in the quenched state is higher than the restoration temperature of alloys B and C.

For alloy C, a considerable increase in the grain appears at 800° C.

EXAMPLE 2

Alloys A, B and C of Example 1 are taken in the cold-rolled state, of thickness 2.2 mm. The alloys A, B, C are annealed for one hour at 700° C. and this treatment is followed by a cold-rolling down to 1.3 mm. They are again annealed at 700° C. for one hour, cooled in the furnace and again cold rolled to a variable thickness.

The mechanical and physical characteristics are then measured and shown on Table III hereinafter, as a function of the rate of cold-rolling.

Alloy A, the only one in accordance with the invention, is the one which possesses the best compromise of mechanical and electrical properties. On the other hand, alloy B has weak electrical properties and alloy C had the weakest mechanical characteristics without having a very high electrical conductivity.

EXAMPLE 3

Alloys A, B and C of Example 2 are taken in the annealed state, at 1.3 mm thickness. This annealing was effected at 700° C. and followed by a cooling in the furnace. Said alloys are then rolled to a thickness of 0.45 mm, or a cold-rolling of 65%, and they are again annealed at different temperatures for one hour.

The mechanical properties are measured on the alloys thus obtained, which are shown on Table IV hereinafter as a function of the annealing temperature.

It is alloy A which keeps the best compromise between the heat conductivity and behaviour at restoration. This result is particularly marked after a dwell time of 1 hour at 400° C.

EXAMPLE 4

An alloy D of composition:

| | | |
|---|---|---|
| Co | 0.27% | $\left(\frac{Co}{P}\text{ ratio} = 3.07\right)$ |
| P | 0.074% | |
| Cu | remainder | |

is melted, cast and hot rolled under the same conditions as the alloys A, B and C of Example 1. After hot rolling, the alloy D is surfaced then cold rolled to a thickness of 2.2 mm. It is then dissolved at about 850° C. for a short time and sharply cooled.

After dissolving, the alloy D undergoes a tempering treatment for 1 hr. 30 mins. at 535° C. It is then rerolled to variable thicknesses. Table V hereafter gives the characteristics obtained for the different cold-rolling rates.

EXAMPLE 5

The alloy D is taken in the quenched state, then tempered, then cold rolled by 16.6, 33.3, 50 and 66.7% in the conditions already defined in the preceding Example. The samples thus obtained are annealed for 1 hour at 400°, 450°, 500°, 550° and 600° C., which enables their behaviour at restoration to be assessed. The results obtained are shown in Table VI hereinafter.

It is noted that the alloy D according to the invention conserves, even after a dwell time at high temperature, an excellent compromise of electrical and mechanical properties.

EXAMPLE 6

Alloys Nos. 1 to 9, the % compositions of which are given in Table VII hereinafter within the framework of a laboratory experiment, are elaborated in a graphite crucible in an argon atmosphere, in the form of ingots of about 1 kg.

Said ingots are cold rolled and an annealing is effected for 30 mins. at 700° C. Said alloys are again deformed by rolling and test pieces cold-rolled respectively by 16.6, 33.3, 50 and 66.7% are taken.

The mechanical characteristics and the electrical conductivity of the alloys thus obtained are measured. The values found are shown on Table VIII hereinafter in comparison with alloy No. 9 in accordance with the invention, but not containing any supplementary addition element.

EXAMPLE 7

The alloys of Example 6, whose compositions have been given in Table VII hereinafter, taken in the 66.7% cold rolled state as defined in Example 6, are annealed for 1 hour at different temperatures. After annealing, the mechanical characteristics and the electrical conductivity are measured. The values are shown on Table IX hereinafter in comparison with those furnished by alloy No. 9 containing only Co and P.

When annealing operations are carried out up to a temperature not exceeding 300° C., the difference in behaviour between the alloys comprising or not comprising an addition of Ag, Cd, Zn, Sn, Mg is not very substantial.

Very clear differences appear when annealing is carried out towards 400° and 500° C. At these temperatures, the alloys having received a supplementary addition of one of the elements Ag, Cd, Sn, Zn, Mg, conserve mechanical properties superior to those obtained with the alloy No. 9 containing solely an addition of Co and P.

These results reveal that the alloys numbered from 1 to 8 have a better behaviour to temperature and show that they are more advantageously used for the production of pieces having to undergo heating.

EXAMPLE 8

Alloys Nos. 10 to 15, whose compositions are given in Table X hereinafter within the scope of a laboratory experiment, are elaborated in a graphite crucible in an argon atmosphere, in the form of ingots of about 1 kg.

Said ingots are cold rolled and an annealing is effected for 30 mins. at 700° C. Said ingots are deformed again until a 50% cold-rolling is attained, still calculated by the formula:

$$\frac{S_o - S}{S_o} \times 100$$

At this stage, a dissolving treatment is carried out for 5 mins. at 920° C. and the samples are quenched. Said samples are then cold-rolled by 16.6, 33.3, 50, 66.7 and 80% and a tempering treatment is effected between 450° and 550° C. The Vickers hardness under 10 kg of the samples thus obtained is measured and the results are shown on Table XI hereinafter.

The hardness values obtained by combining the effects of a hardening treatment with the effects of a cold-rolling show a clear advantage for alloys having received a supplementary addition of Cd, Zn, Mg or Ag with respect to alloy No. 15 containing only $C_o$ and P, particularly in that the hardness attained is higher.

EXAMPLE 9

Alloys Nos. 10 to 15 dissolved, cold-rolled according to the method used in Example 8 and tempered at a chosen temperature so as to attain a hardening and a maximum electrical conductivity, are then exposed for 1 hour to temperatures varying between 400° and 600° C. In this way, the loss of mechanical characteristics for alloys Nos. 10 to 15 previously cold-rolled and tempered upon possible stresses by prolonged raising of temperature is assessed. The results shown on Table XII hereinafter are figures of Vickers hardness under 10 kg measured after a dwell time of 1 hour at the temperature of the test. It is ascertained that the loss of mechanical characteristics is limited up to 550° C. but that it is more rapid for alloy No. 15 above 550° C. than for alloys Nos. 10 to 14.

EXAMPLE 10

In an industrial production test, an alloy of composition:

| | | |
|---|---|---|
| Co | 0.22 | $\frac{Co}{P}$ ratio = 3.14 |
| P | 0.070 | |
| Mg | 0.047 | |
| Cu | remainder | |

is elaborated in the form of a billet of diameter 120 mm, taking the precaution of using principal alloys Cu-Co, Cu-P and Cu-Mg.

This billet is cut into elements of length 600 mm and extruded hot at a temperature of 850° C. and to a diameter of 8 mm (or an extrusion ratio of 225). The wire obtained is cooled sharply, immediately after extrusion, and is thus quenched.

A tempering treatment is made on the wire obtained for 2 hours at 550° C. and it is deformed cold. The mechanical and physical characteristics obtained are shown on Table XIII hereinafter as a function of the cold-rolling rate.

EXAMPLE 11

In the course of an industrial test, an alloy of composition:

| | | |
|---|---|---|
| Co | 0.23 | $\frac{Co}{P}$ ratio = 3.15 |
| P | 0.073 | |
| Mg | 0.078 | |
| Cu | remainder | |

is elaborated in the form of an ingot of thickness 150 mm, taking the precaution of using principal alloys Cu-Co, Cu-P and Cu-Mg.

This ingot is preheated to 930° C. and hot rolled to a thickness of 8 mm. It is then cold rolled to thickness 1.6 mm and treated to be hardened. This treatment comprises a dissolving of very short duration at 900° C. and a tempering for 2 hours at 550° C. The alloy is then rerolled to thickness 1.2 mm.

At this stage, the rolled articles obtained present the following characteristics:

R: 43–50 daN/mm$^2$
E: 36–39 daN/mm$^2$
A%: 3–5
HV: 141–154 daN/mm$^2$
IACS %: 82–86

With the rolled article thus obtained, shaped pieces are made by press-cutting. These shaped pieces are assembled by brazing by means of a high frequency apparatus and with an addition metal of composition:

| Ag | Cu | Zn | Cd |
|---|---|---|---|
| 45% | 15% | 16% | 24% |

of which the melting range is given for approximately 605°–620° C.

A measurement of hardness verifies that the shaped pieces retain the properties of the cold-rolled treated state, after the brazing cycle.

| Distance of the brazed zone | HV before brazing | HV after brazing |
|---|---|---|
| Reverse of the brazed surface | 141–154 | 102–104 |
| 3 mm | 142–154 | 114–118 |
| 6 mm | 150–154 | 122–127 |
| 9 mm | 142–144 | 140–137 |

TABLE I

| Alloy | Composition Co | Ni | Fe | Zn | P | Ratio $\frac{Co}{P}$ or $\frac{Co + Ni + Fe}{P}$ |
|---|---|---|---|---|---|---|
| A | 0.15 | 0.016 | 0.016 | 0.003 | 0.058 | 3.13 |
| B | 0.11 | 0.09 | | | 0.087 | 2.30 |
| C | 0.12 | 0.055 | | | 0.028 | 6.25 |

TABLE II

| Temperature of treatment | Vickers hardness under 10 kg A | B | C | Grain index according to AFNOR A 04-104 A | B | C |
|---|---|---|---|---|---|---|
| Cold-rolled | 135 | 152 | 128 | — | — | — |
| 400° C. | 151 | 151 | 128 | — | — | — |
| 500° C. | 135 | 100 | 77 | — | — | — |
| 600° C. | 77 | 75 | 68 | 8 | 7–8 | 7–8 |
| 800° C. | 51 | 55 | 35 | 7 | 6–7 | 1–2 |

TABLE III

| Rate of cold-rolling | Tensile strength daN/mm$^2$ A | B | C | Elastic limit daN/mm$^2$ A | B | C | Extension % A | B | C | Vickers hardness under 10 kg A | B | C | conductivity IACS % A | B | C |
|---|---|---|---|---|---|---|---|---|---|---|---|---|---|---|---|
| as such | 26.3 | 27 | 24.6 | 9.8 | 10 | 7.8 | 47 | 40 | 48 | 59 | 60 | 54 | 80 | 62.5 | 73 |
| 24% | 35.6 | 36.4 | 37.5 | 34.8 | 35.3 | 32.5 | 8 | 11 | 8 | 119 | 119 | 109 | 75 | 62.5 | 73 |
| 32% | 38.7 | 38.8 | 36.1 | 37.4 | 38 | 35 | 4 | 6 | 5.5 | 124 | 122 | 116 | 76.5 | 65 | 73 |
| 47% | 41.1 | 41.8 | 38.7 | 40.3 | 40.8 | 37.5 | 3 | 5 | 5 | 128 | 130 | 122 | 83 | 69 | 80 |
| 57% | 42.7 | 43.2 | 41 | 41.8 | 42.2 | 39 | 3 | 2 | 4 | 129 | 132 | 125 | 87.5 | 72 | 83.5 |
| 65% | 44.1 | 44.8 | 42 | 42.8 | 43.2 | 40.5 | 2 | 2 | 4 | 128 | 135 | 125 | 84 | 67 | 80 |
| 75% | 45.8 | 46.1 | 43.3 | 43.5 | 44.1 | 40.8 | 2 | 2.5 | 3.5 | 131 | 137 | 124 | 84 | 69 | 81 |

TABLE IV

| Annealing Temperature °C. | Tensile strength daN/mm$^2$ A | B | C | Elastic limit daN/mm$^2$ A | B | C | Extension % A | B | C | Conductivity IACS % A | B | C |
|---|---|---|---|---|---|---|---|---|---|---|---|---|
| 100 | 45.4 | 47.2 | 43.4 | 43.4 | 45.5 | 41.9 | 1.1 | 0.6 | 1.0 | 78 | 67 | 73 |
| 200 | 44.7 | 46.5 | 42.1 | 41.9 | 45.5 | 40.1 | 1.3 | 0.8 | 1.4 | 78 | 67 | 74 |
| 300 | 42.1 | 43.3 | 40.6 | 38.9 | 39.6 | 38.7 | 4.3 | 3.2 | 3.5 | 79 | 67 | 75 |
| 400 | 37 | 41.2 | 29.1 | 30.3 | 36.8 | 18 | 6.6 | 7.8 | 21.8 | 88 | 70 | 79 |
| 500 | 29.6 | 29.2 | 28.1 | 14.8 | 15.6 | 13 | 33 | 31.6 | 30.1 | 88 | 76 | 82 |
| 600 | 28.9 | 27.9 | 27.2 | 13 | 11.7 | 11.7 | 34.5 | 35.4 | 33.8 | 86 | 74 | 83 |

TABLE IV-continued

| Annealing Temperature | Tensile strength daN/mm² | | | Elastic limit daN/mm² | | | Extension % | | | Conductivity IACS % | | |
|---|---|---|---|---|---|---|---|---|---|---|---|---|
| °C. | A | B | C | A | B | C | A | B | C | A | B | C |
| 700 | 27.6 | 26.8 | 25.1 | 13 | 11.2 | 10.3 | 33.3 | 35.3 | 36.3 | 86 | 72 | 79 |
| 800 | 26.2 | 23.5 | 23.5 | 9.9 | 10.2 | 10 | 28.7 | 13 | 13.9 | 78 | 68 | 68 |

TABLE V

| Rate of cold-rolling | R daN/mm² | E daN/mm² | HV | A % | Conductivity IACS % |
|---|---|---|---|---|---|
| 16.6% | 38 | 32.1 | 118 | 8 | 85 |
| 33.3% | 43.5 | 38.5 | 135 | 4 | 84 |

TABLE V-continued

| Rate of cold-rolling | R daN/mm² | E daN/mm² | HV | A % | Conductivity IACS % |
|---|---|---|---|---|---|
| 50% | 47.5 | 41.5 | 144 | 3 | 84 |
| 66.7% | 50.5 | 44 | 151 | 2.5 | 85 |

TABLE VI

| Temperature °C. | Cold-rolled 16.6% | | | | | Cold-rolled 33.3% | | | | | Cold-rolled 50% | | | | | Cold-rolled 66.6% | | | | |
|---|---|---|---|---|---|---|---|---|---|---|---|---|---|---|---|---|---|---|---|---|
| | R | E | HV | A % | IACS % | R | E | HV | A % | IACS % | R | E | HV | A % | IACS % | R | E | HV | A % | IACS % |
| 400 | 38 | 29.8 | 115 | 15 | 89 | 40 | 36 | 129 | 9 | 87 | 43.3 | 40 | 138 | 8 | 87 | 44.1 | 39.2 | 139 | 8 | 86 |
| 450 | 37.5 | 29.1 | 116 | 16.5 | 89 | 39.2 | 34 | 129 | 10.5 | 67 | 42 | 36 | 135 | 11 | 87 | 40 | 31.2 | 124 | 16 | 56 |
| 500 | 36.8 | 28 | 113 | 15 | 89 | 38 | 30.2 | 125 | 13 | 88 | 38 | 28 | 125 | 15 | 86 | 33.4 | 20.8 | 100 | 28 | 88 |
| 550 | 35.7 | 26.1 | 107 | 19.3 | 89 | 36 | 22 | 110 | 17.5 | 89 | 34 | 20.4 | 97 | 22 | 89 | 30 | 16 | 85 | 35 | 89 |
| 600 | 33 | 21.2 | 98 | 23 | 88 | 30.8 | 14.8 | 83 | 25.5 | 88 | 30 | 14 | 75 | 31 | 87 | 29.2 | 13.9 | 77 | 37.5 | 87 |

TABLEAU VII

| n° | Cu | Co | P | Cd | Mg | Ag | Zn | Sn | ratio $\frac{CO}{P}$ |
|---|---|---|---|---|---|---|---|---|---|
| 1 | remainder | 0.23 | 0.057 | 0.26 | | | | | 4.03 |
| 2 | " | 0.23 | 0.065 | 0.31 | | | | | 3.54 |
| 3 | " | 0.24 | 0.050 | 0.47 | | | | | 4.8 |
| 4 | " | 0.27 | 0.083 | | 0.081 | | | | 3.25 |
| 5 | " | 0.25 | 0.081 | | 0.21 | | | | 3.09 |
| 6 | " | 0.25 | 0.086 | | | 0.099 | | | 2.91 |
| 7 | " | 0.25 | 0.074 | | | | 0.34 | | 3.38 |
| 8 | " | 0.25 | 0.059 | | | | | 0.21 | 4.24 |
| 9 | " | 0.24 | 0.051 | | | | | | 4.70 |

TABLE VIII

| Alloy No. | Cold-rolled 16.6% | | | | | Cold-rolled 33.3% | | | | | Cold-rolled 50% | | | | | Cold-rolled 66.7% | | | | |
|---|---|---|---|---|---|---|---|---|---|---|---|---|---|---|---|---|---|---|---|---|
| | R | E | A % | HV | IACS % | R | E | A % | HV | IACS % | R | E | A % | HV | IACS % | R | E | A % | HV | IACS % |
| 1 | 33.1 | 30.5 | 18 | 108 | 85 | 38.7 | 34.5 | 4 | 121 | 83 | 42.5 | 39.2 | 3 | | 86 | 45.7 | 43 | 2 | 130 | 84 |
| 2 | 34.6 | 31.1 | 18 | 111 | 85 | 39.7 | 35.6 | 4 | 122 | 84 | 43.5 | 40.4 | 2.5 | 130 | 84 | 44.6 | 39.9 | 1.5 | 135 | 81 |
| 3 | 35.6 | 31.9 | 16 | 114 | 86 | 40.5 | 33.6 | 4.5 | 122 | 82 | 44.2 | 38.8 | 2.5 | 132 | 85 | 46 | 38.8 | 2 | 141 | 84 |
| 4 | 33.3 | 30.5 | 12 | 107 | 82 | 38.8 | 34.8 | 4 | 119 | 82 | 43.1 | 39 | 2.5 | 128 | 82 | 44.6 | 38.9 | 2 | 134 | 81 |
| 5 | 37.3 | 32.6 | 12 | 116 | 78 | 43 | 40.2 | 3.5 | 130 | 77 | 46.7 | 39 | 2.5 | 139 | 76 | 49.4 | 42.6 | 2 | 141 | 76 |
| 6 | 32.6 | 29.4 | 14 | 106 | 81 | 38.8 | 36.4 | 3.5 | 117 | 82 | 41.3 | 36.5 | 2 | 123 | 80 | 43.3 | 38.9 | 1.5 | 130 | 81 |
| 7 | 31.8 | 28.6 | 18 | 102 | 83 | 37.7 | 33.8 | 4 | 118 | 83 | 41.6 | 36.4 | 2.5 | 122 | 80 | 43.3 | 39.8 | 2 | 129 | 82 |
| 8 | 33.5 | 30.1 | 14 | 109 | 78 | 40 | 34.5 | 4 | 123 | 78 | 44 | 40.6 | 2.5 | 133 | 77 | 45.5 | 41 | 2 | 140 | 76 |
| 9 | 30.3 | 28.7 | 18 | 101 | 80 | 37 | 34 | 4 | 113 | 81 | 41.4 | 38 | 2.5 | 122 | 80 | 43.7 | 40.5 | 2 | 128 | 79 |

R: tensile strength in daN/mm²
E: elastic limit in daN/mm²
A: extension
HV: Vickers hardness under 10 kg in daN/mm²
IACS: conductivity IACS

TABLE XI

| Alloy No. | Annealing at 200° C. for 1 hr. | | | | | Annealing at 300° C. for 1 Hr. | | | | | Annealing at 400° C. for 1 hr. | | | | |
|---|---|---|---|---|---|---|---|---|---|---|---|---|---|---|---|
| | R | E | A % | HV | IACS % | R | E | A % | HV | IACS % | R | E | A % | HV | IACS % |
| 1 | 46 | 41.1 | 3.5 | 130 | 85 | 43.6 | 39.7 | 5 | 132 | 91 | 37.4 | 27.2 | 10 | 115 | 91 |
| 2 | 44.2 | 38.6 | 3.5 | 132 | 87 | 42.4 | 37.5 | 6 | 131 | 87 | 36.6 | 26.3 | 16.5 | 116 | 85 |
| 3 | 46 | 41.2 | 3 | 132 | 87 | 43.4 | 38.6 | 6 | 134 | 86 | 35.8 | 26.1 | 12 | 103 | 85 |
| 4 | 42 | 35.8 | 3 | 135 | 85 | 39 | 32 | 4 | 134 | 85 | 35 | 25.3 | 18.5 | 106 | 91 |
| 5 | 46.1 | 37.4 | 2 | 149 | 78 | 43.2 | 35.4 | 10 | 142 | 79 | 37.2 | 24.3 | 20 | 113 | 80 |
| 6 | 40.9 | 34.1 | 2.5 | 131 | 85 | 39.2 | 33.8 | 7 | 127 | 86 | 30.7 | 15.5 | 25 | 60 | 91 |
| 7 | 41.6 | 35.9 | 2.5 | 127 | 63 | 38.9 | 30.6 | 6 | 124 | 85 | 29.5 | 13.1 | 31.7 | 90 | 89 |
| 8 | 43.1 | 37.2 | 2 | 139 | 77 | 41 | 34.8 | 7 | 132 | 78 | 34.2 | 23.4 | 20.5 | 94 | 81 |

TABLE XI-continued

| | | | | | | | | | | | | | | | |
|---|---|---|---|---|---|---|---|---|---|---|---|---|---|---|---|
| 9 | 42.6 | 40.2 | 2 | 124 | 80 | 42.3 | 37.4 | 3 | 124 | 80 | 26.7 | 10.4 | 36.5 | 70 | 83 |

| Alloy No. | Annealing at 500° C. for 1 Hr R | E | A % | HV | IACS % | Annealing at 600° C. for 1 hr. R | E | A % | HV | IACS % |
|---|---|---|---|---|---|---|---|---|---|---|
| 1 | 32.2 | 17.6 | 30.5 | 80 | 91 | 30.8 | 15.2 | 31 | 83 | 96 |
| 2 | 32.7 | 21.1 | 28 | 102 | 90 | 30.6 | 16.6 | 30 | 81 | 91 |
| 3 | 35 | 20 | 26 | 97 | 91 | 32 | 14.6 | 28 | 83 | 93 |
| 4 | 30.7 | 14.5 | 30 | 85 | 86 | 29.6 | 11.7 | 32.5 | 80 | 91 |
| 5 | 32 | 14.3 | 34 | 86 | 81 | 31.9 | 14.2 | 32 | 85 | 80 |
| 6 | 28.4 | 12.2 | 31 | 72 | 91 | 28 | 11.1 | 31 | 71 | 89 |
| 7 | 28.8 | 12.1 | 35 | 80 | 89 | 27.9 | 11.2 | 36 | 75 | 85 |
| 8 | 30.5 | 11.5 | 31 | 84 | 81 | 29.3 | 12.1 | 40 | 77 | 80 |
| 9 | 26.5 | 9.8 | 38.5 | 64 | 82 | 26.3 | 9.5 | 37 | 62 | 80 |

R: tensile strength in daN/mm$^2$
E: elastic limit in daN/mm$^2$
A: extension
HV: Vickers hardness under 10 kg in daN/mm$^2$
IACS: conductivity IACS

TABLE X

| n° | Cu | Co | P | Cd | Mg | Ag | Zn | Ratio Co/P |
|---|---|---|---|---|---|---|---|---|
| 10 | remainder | 0.23 | 0.078 | 0.11 | | | | 2.95 |
| 11 | " | 0.22 | 0.081 | | | | 0.25 | 2.72 |
| 12 | " | 0.22 | 0.067 | | | 0.068 | | 3.28 |
| 13 | " | 0.25 | 0.076 | | 0.06 | | | 3.29 |
| 14 | " | 0.20 | 0.058 | | 0.09 | | | 3.45 |
| 15 | " | 0.25 | 0.055 | | | | | 4.54 |

TABLE XI

| Alloy N° | Tempering at 450° C. after cold-rolling hereinbelow 16.6% | 33.3% | 50% | 66.7% | 80% | Tempering at 500° C. after cold-rolling hereinbelow 16.6% | 33.3% | 50% | 66.7% | 80% | Tempering at 550° C. after cold-rolling hereinbelow 16.6% | 33.3% | 50% | 66.7% | 80% |
|---|---|---|---|---|---|---|---|---|---|---|---|---|---|---|---|
| 10 | 110 | 130 | 139 | 141 | 147 | 114 | 130 | 145 | 154 | 161 | 124 | 134 | 134 | 141 | 131 |
| 11 | 112 | 130 | 139 | 153 | 157 | 128 | 133 | 142 | 150 | 131 | 117 | 128 | 139 | 132 | 106 |
| 12 | 111 | 124 | 138 | 153 | 161 | 120 | 130 | 138 | 155 | 154 | 122 | 125 | 140 | 138 | 103 |
| 13 | 114 | 131 | 149 | 148 | 164 | 130 | 142 | 154 | 160 | 163 | 118 | 126 | 145 | 138 | 139 |
| 14 | 121 | 142 | 147 | 157 | 168 | 126 | 144 | 156 | 161 | 160 | 121 | 124 | 145 | 142 | 131 |
| 15 | 110 | 129 | 131 | 145 | 138 | 112 | 127 | 129 | 139 | 106 | 110 | 113 | 118 | 99 | 75 |

TABLE XII

| Alloy No. | 1 h at 400° C. 16.6 % | 33.3 % | 50 % | 66.7 % | 1 h at 450° C. 16.6 % | 33.3 % | 50 % | 66.7 % | 1 h at 500° C. 16.6 % | 33.3 % | 50 % | 66.7 % | 1 h at 550° C. 16.6 % | 33.3 % | 50 % | 66.7 % | 1 h at 600° C. 16.6 % | 33.3 % | 50 % | 66.7 % |
|---|---|---|---|---|---|---|---|---|---|---|---|---|---|---|---|---|---|---|---|---|
| 10 | | | | | 128 | 132 | 135 | 151 | 124 | 129 | 141 | 153 | 121 | 132 | 134 | 141 | 111 | 121 | 120 | 91 |
| 11 | 129 | 137 | 140 | 145 | 125 | 134 | 141 | 147 | 129 | 132 | 145 | 145 | 125 | 128 | 125 | 113 | 108 | 111 | 105 | 88 |
| 12 | 178 | 137 | 136 | 147 | 125 | 134 | 142 | 146 | 124 | 128 | 144 | 134 | 117 | 127 | 139 | 129 | 108 | 111 | 121 | 91 |
| 13 | 127 | 141 | 148 | 159 | 129 | 139 | 155 | 158 | 128 | 137 | 157 | 155 | 125 | 127 | 139 | 133 | 106 | 115 | 120 | 119 |
| 14 | 127 | 139 | 148 | 161 | 133 | 141 | 155 | 160 | 134 | 138 | 151 | 150 | 122 | 128 | 135 | 126 | 112 | 114 | 121 | 100 |
| 15 | 112 | 124 | 134 | 141 | 111 | 128 | 135 | 139 | 113 | 127 | 134 | 136 | 110 | 126 | 130 | 111 | 108 | 112 | 100 | 77 |

TABLE XIII

| Rate of cold-rolling $\frac{S_o - S}{S_o} \times 100$ | R | E | A % | HV | IACS % |
|---|---|---|---|---|---|
| 40% | 49.8 | 18.8 | 7 | 138 | 82 |
| 52% | 50.2 | 21.9 | 4 | 145.5 | 83 |
| 70% | 53.6 | 31.1 | 2.5 | 154 | 81 |
| 82% | 55.6 | 45.9 | 2 | 159 | 80 |

R: tensile strength in daN/mm$^2$
E: elastic limit in daN/mm$^2$
A: extension
HV: Vickers hardness under 10 kg in daN/mm$^2$
IACS: conductivity IACS

What is claimed is:

1. A copper alloy consisting essentially of 0.1 to 0.50% by weight of cobalt, 0.04 to 0.25% by weight of phosphorus, the remainder being copper, said cobalt and phosphorus being present in a weight ratio of cobalt to phosphorus of between 2.5 to 5, said alloy having a high electrical conductivity of at least 75% IACS; and said alloy, when subjected to thermal-mechanical treatment having a hardness of at least about 90 HV.

2. The alloy of claim 1, wherein the amounts of cobalt and phosphorus are as follows: 0.15 to 0.35% by weight of cobalt; 0.05 to 0.12% by weight of phosphorus.

3. A copper alloy consisting essentially of: 0.10 to 0.4% by weight of cobalt, 0.04 to 0.25% by weight of phosphorus, and up to 0.15% by weight of nickel and/or iron, the nickel content not being higher than 0.05% and the iron content not being higher than 0.01% and the remainder being copper, wherein the weight percentages of Ni, Co, Fe and P are chosen so that the ratio of the weight of Ni+Co+Fe to the weight of phosphorus is between 2.5 and 5, said alloy having a high electrical conductivity of at least 75% IACS, and said alloy, when subjected to thermal-mechanical treatment, having a hardness of at least about 90 HV.

4. A copper alloy consisting essentially of: 0.10 to 0.50% by weight of cobalt, 0.04 to 0.25% by weight of phosphorus, and at least one element selected from the group consisting of Mg, Cd, Ag, Zn and Sn, the remainder being copper, the weight percentage of said element, when present, being 0.01 to 0.35 Mg, 0.01 to 0.7 Cd, 0.01 to 0.35 Ag, 0.01 to 0.7 Zn and 0.01 to 0.25 Sn the total content of said elements not exceeding 1% by weight, said cobalt and phosphorus being present in a weight ratio of cobalt to phosphorus of between 2.5 to 5, said alloy having a high electrical conductivity of at least 75% IACS; and said alloy, when subjected to thermal-mechanical treatment, having a hardness of at least about 90 HV.

5. A copper alloy consisting essentially of: 0.10 to 0.4% by weight of cobalt, 0.04 to 0.25% by weight of phosphorus, up to 0.15% by weight of nickel and/or iron, the nickel content not being higher than 0.05% and the iron content not being higher than 0.1% and at least one element selected from the group consisting of Mg, Cd, Ag, Zn and Sn, the remainder being copper, the weight percentage of said element, when present, being 0.01 to 0.35 Mg, 0.01 to 0.7 Cd, 0.01 to 0.35 Ag, 0.01 to 0.7 Zn and 0.01 to 0.25 Sn, the total content of said elements not exceeding 1% by weight, wherein the weight percentage of Ni, Co, Fe and P are chosen so that the ratio of the weight of Ni+Co+Fe to the weight of phosphorus is between 2.5 and 5, said alloy having a high electrical conductivity of at least 75% IACS; and said alloy, when subjected to thermal-mechanical treatment, having a hardness of at least about 90 HV.

* * * * *